US007452043B2

(12) United States Patent
Ono et al.

(10) Patent No.: US 7,452,043 B2
(45) Date of Patent: Nov. 18, 2008

(54) LIQUID DROP DISCHARGING DEVICE AND LIQUID DROP DISCHARGING METHOD

(75) Inventors: Yoshihiko Ono, Kanagawa (JP); Toru Nishida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 230 days.

(21) Appl. No.: 11/580,506

(22) Filed: Oct. 13, 2006

(65) Prior Publication Data

US 2007/0296751 A1 Dec. 27, 2007

(30) Foreign Application Priority Data

May 17, 2006 (JP) ..... 2006-137962

(51) Int. Cl.
*B41J 29/38* (2006.01)

(52) U.S. Cl. ..... 347/14; 347/104; 347/105

(58) Field of Classification Search ..... 347/14
See application file for complete search history.

(56) References Cited

U.S. PATENT DOCUMENTS 7,399,045 B2 * 7/2008 Nishida et al. ..... 347/14
2003/0043229 A1 * 3/2003 Kawatoko et al. ..... 347/37

FOREIGN PATENT DOCUMENTS

| | | |
|---|---|---|
| JP | 6-198868 | 7/1994 |
| JP | 2002-36528 | 2/2002 |
| JP | 2002-67357 | 3/2002 |

* cited by examiner

*Primary Examiner*—Matthew Luu
*Assistant Examiner*—Brian J Goldberg
(74) *Attorney, Agent, or Firm*—Fildes & Outland, P.C.

(57) ABSTRACT

There is provided a liquid drop discharging device including: a liquid drop discharging head that discharges liquid drops onto a recording sheet; a discharged region computing section that, on the basis of inputted image data, computes a size of a region where liquid drops are to be discharged on the recording sheet by the liquid drop discharging head; a margin proportion computing section that, on the basis of the computed size of the discharged region and a size of the recording sheet, computes a proportion of a margin of the recording sheet; and a determination section that, when the computed proportion of the margin is less than a predetermined margin proportion, determines that sheet curling will occur at the recording sheet on which an image is recorded by liquid drop discharging of the liquid drop discharging head.

21 Claims, 8 Drawing Sheets

LIQUID DROP DISCHARGING DEVICE AND LIQUID DROP DISCHARGING METHOD

BACKGROUND

1. Technical Field

The present invention relates to a liquid drop discharging device and a liquid drop discharging method, and in particular, relates to a liquid drop discharging device and a liquid drop discharging method which discharge liquid drops onto a recording sheet on the basis of image data.

2. Related Art

Conventionally, in a liquid drop discharging device such as an inkjet printer or the like, ink drops are discharged onto a recording sheet by an ink drop discharging head, and an image is recorded. If the ink drops are a water-based ink, at the surface of the recording sheet, the portions at which the ink drops have been discharged swell, and the length of the surface varies at the front side and the back side. As a result, curling occurs at the recording sheet. Further, when the moisture of the ink drops evaporates, the portions where the ink drops have been discharged contract, and curling in the opposite direction occurs.

The behavior of the sheet curling varies in accordance with the size of the margin of the recording sheet. However, conventional inkjet recording devices do not consider the size of the margin of the recording sheet. Therefore, the occurrence of curling cannot be predicted with high accuracy, and processing for accurately suppressing the occurrence of curling cannot be implemented.

SUMMARY

An aspect of the present invention is a liquid drop discharging device including: a liquid drop discharging head that discharges liquid drops onto a recording sheet; a discharged region computing section that, on the basis of inputted image data, computes a size of a region where liquid drops are to be discharged on the recording sheet by the liquid drop discharging head; a margin proportion computing section that, on the basis of the computed size of the discharged region and a size of the recording sheet, computes a proportion of a margin of the recording sheet; and a determination section that, when the computed proportion of the margin is less than a predetermined margin proportion, determines that sheet curling will occur at the recording sheet on which an image is recorded by liquid drop discharging of the liquid drop discharging head.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail hereinafter with reference to the drawings. In these embodiments, cases in which the present invention is applied to inkjet recording devices will be described as examples.

Figure 1:
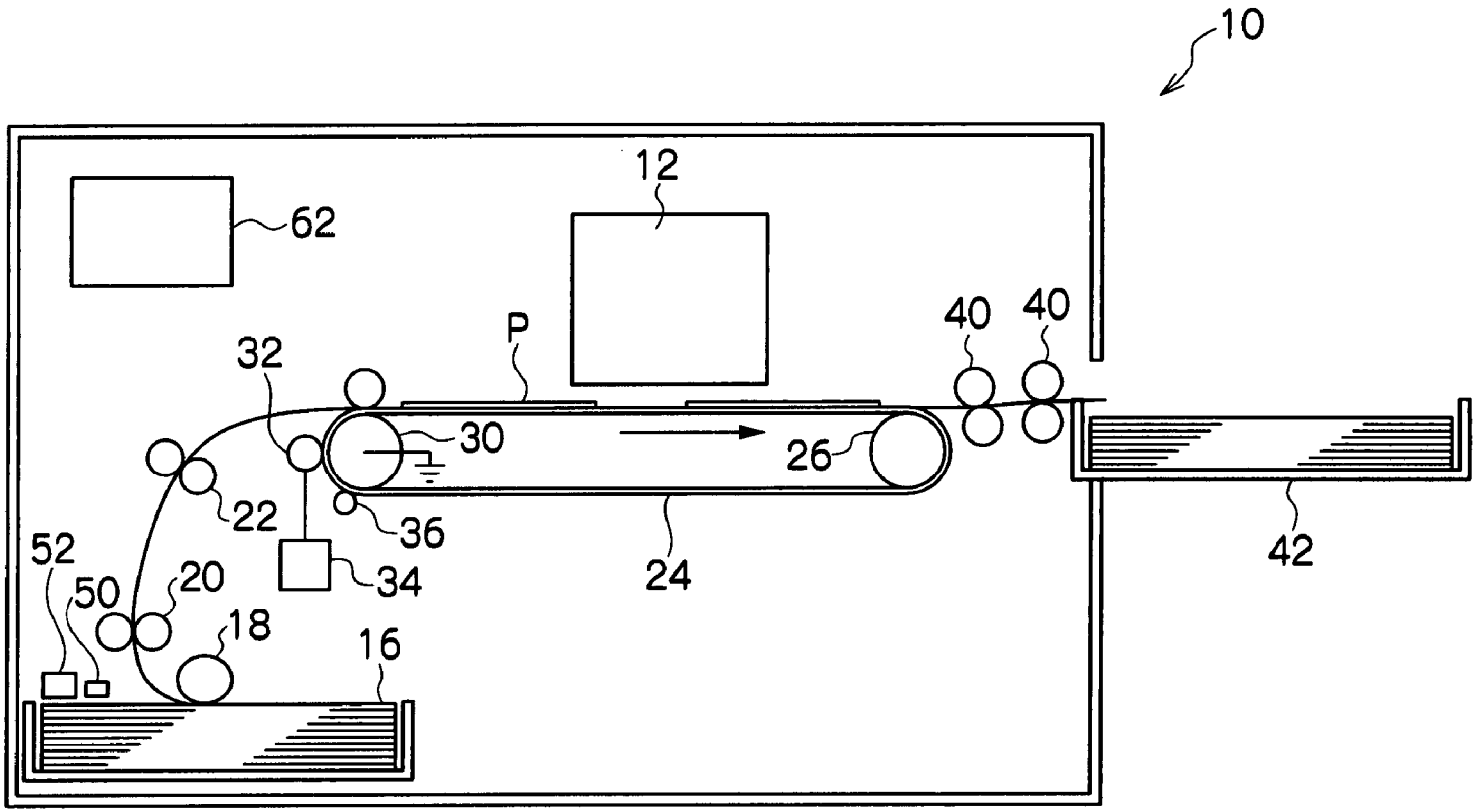
FIG. 1 is a schematic drawing showing the structure of an inkjet recording device relating to a first exemplary embodiment.

As shown in FIG. 1, an inkjet recording device 10 relating to a first exemplary embodiment includes an inkjet head unit 12 which discharges ink drops onto a recording sheet P. The inkjet head unit 12 has inkjet heads (not shown) which discharge, from nozzles, water-based dye or pigment inks of the four colors of cyan (C), magenta (M), yellow (Y), and black (K), and a processing liquid. A liquid, which is transparent or light-colored and which contains a component for making the dyes or pigments within the inks insoluble, thicken or cohere, is used as the processing liquid.

For example, with respect to an ink which contains a pigment having an anionic radical, it suffices for the processing liquid to contain electrolytes or a cationic compound or the like. Electrolytes which are effectively used in the present invention are, for example, alkali metal ions such as lithium ions, sodium-ions, potassium ions, and the like, polyvalent metal ions such as aluminum ions, barium ions, calcium ions, copper ions, iron ions, magnesium ions, manganese ions, nickel ions, tin ions, titanium ions, zinc ions, and the like, salts of hydrochloric acid, hydrobromic acid, hydroiodic acid, sulfuric acid, nitric acid, phosphoric acid, thiocyanic acid, and salts of organic carboxylic acids and organic sulfonic acids such as acetic acid, oxalic acid, lactic acid, fumaric acid, citric acid, salicylic acid, benzoic acid, and the like.

The inkjet head is an elongated head having an effective printing region corresponding to the width of the recording sheet P, and plural nozzles are arrayed thereat along the transverse direction of the recording sheet P. The inkjet heads discharge ink drops and drops of the processing liquid all at once onto the transverse direction printing region of the recording sheet P. Further, a known method such as a thermal method, or a method of applying pressure to ink chambers by piezoelectric elements, or the like, can be used as the method for causing ink drops to be discharged from the nozzles of the inkjet heads.

Note that the inkjet head unit 12 may be provided with a main scanning mechanism which moves the inkjet heads in a main scanning direction, and use inkjet heads whose effective printing regions are smaller than the width of the recording sheet P.

A sheet feed tray 16 is provided so as to be able to be inserted and removed at the lowermost portion of the inkjet recording device 10. The recording sheets P are stacked in the sheet feed tray 16, and a pick-up roller 18 abuts the uppermost recording sheet P. The recording sheets P are fed by the pick-up roller 18 one-by-one from the sheet feed tray 16 toward the conveying direction downstream side, and are fed to the region beneath the inkjet head unit 12 by conveying rollers 20, 22 which are disposed in order along the conveying path.

A humidity sensor 50, which is for detecting the humidity within the sheet feed tray 16, and a humidifier 52, which is for humidifying the recording sheets P by humidifying the interior of the sheet feed tray 16, are provided within the sheet feed tray 16.

An endless conveying belt 24 is disposed beneath the inkjet head unit 12. The conveying belt 24 is stretched around a driving roller 26 and a driven roller 30. The driven roller 30 is grounded.

A charging roller 32 is disposed at the upstream side of the position where the recording sheet P contacts the conveying belt 24. A DC power source device 34 which supplies DC power is connected to the charging roller 32. The charging roller 32 can move between a contacting position, at which the charging roller 32 contacts the conveying belt 24 and is driven while nipping the conveying belt 24 between itself and the driven roller 30, and a separated position at which the charging roller 32 is separated from the conveying belt 24. At the contacting position, a predetermined potential difference arises between the charging roller 32 and the driven roller 30 which is grounded. Therefore, discharging and the applying of charges are carried out with respect to the conveying belt 24. The conveying belt 24 can thereby electrostatically attract the recording sheet P.

A charge removing roller 36, which is for removing the charges which are charged on the conveying belt 24, is provided at the upstream side of the charging roller 32.

Plural discharging roller pairs 40, which structure a discharge path of the recording sheet P, are provided at the downstream side of the inkjet head unit 12. A catch tray 42 is provided at the end of the discharge path formed by the discharging roller pairs 40.

A controller 62, which is structured from a CPU, a ROM, and a RAM, is provided at the inkjet recording device 10. The overall inkjet recording device 10, including the inkjet head unit 12 and the plural motors (not shown) which drive the various types of rollers, is controlled by the controller 62.

Changes in the behavior of sheet curling after printing, based on the margin of the recording sheet P and the printing environment in a case in which the recording sheet P is printed, will be described next by using FIG. 2.

Figure 2:
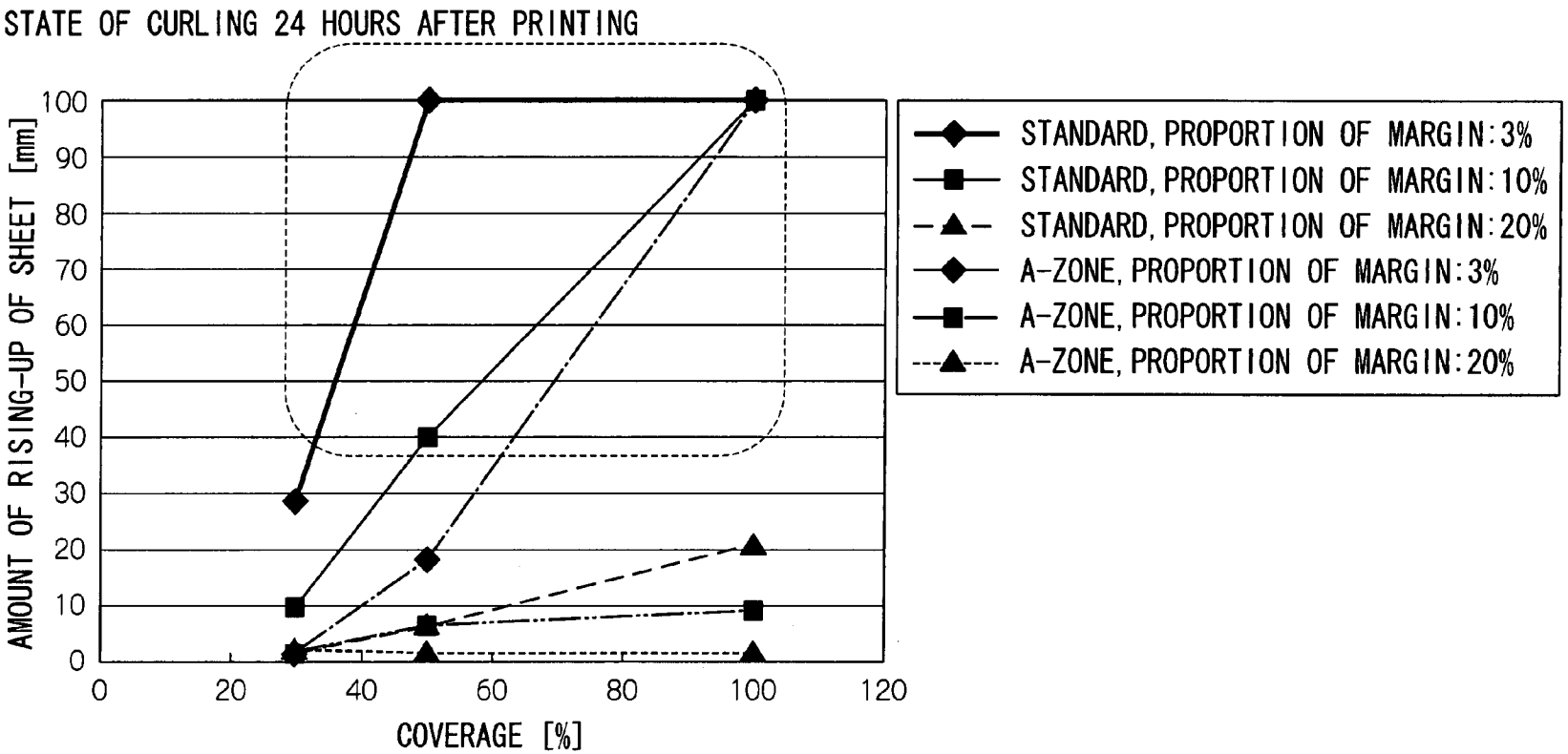
FIG. 2 is a graph showing changes in the behavior of sheet curling after printing, based on the proportion of the margin of a recording sheet and on the printing environment in a case in which a recording sheet is printed.

FIG. 2 shows the curled states of the recording sheets P 24-hours after printing, and shows the curled states of the printed recording sheets P whose proportions of the margin are 3%, 10%, and 20% respectively, in a case in which the printing environment is standard and in a case in which the printing environment is an A-zone (temperature 28° C., humidity 85%).

Here, the region surrounded by the dotted line shows cases in which the proportion of the margin is low. When the proportion of the margin is 3%, sheet curling of an extent that the sheet rolls-up arises at the recording sheet P after printing. On the other hand, when the proportion of the margin is 20% which is high, hardly any sheet curling occurs.

Even when the proportion of the margin is 10%, if the printing ratio (coverage) is 30% or less, the occurrence of sheet curling is suppressed. However, if the printing ratio exceeds 30%, great sheet curling occurs.

Further, the occurrence of sheet curling is suppressed at higher humidities.

The relationship between the margin and the direction of the sheet curling at the recording sheet P will be described next. In a case in which sheet curling at the recording sheet P after printing arises in the transverse direction (the widthwise direction), the sheet curling is suppressed by the margins at the leading and trailing ends. Therefore, the greater the proportion of the margin in the lengthwise direction which is the direction orthogonal to the transverse direction, the more that the sheet curling is suppressed. On the other hand, in a case in which sheet curling arises in the lengthwise direction, the sheet curling is suppressed by the margins at the left and right ends. Therefore, the greater the proportion of the margin in the widthwise direction which is the direction orthogonal to the lengthwise direction, the more that the sheet curling is suppressed.

Note that the direction of the sheet curling is determined by the direction of the texture of the paper of the recording sheet P. Further, the texture of the paper varies in accordance with the size of the recording sheet P. Therefore, the direction of the sheet curling varies in accordance with the size of the recording sheet P.

Operation of the inkjet recording device 10 relating to the first exemplary embodiment will be described next. Note that explanation will be given of a case in which transverse direction (widthwise direction) sheet curling arises at the printed recording sheet P.

Figure 3:
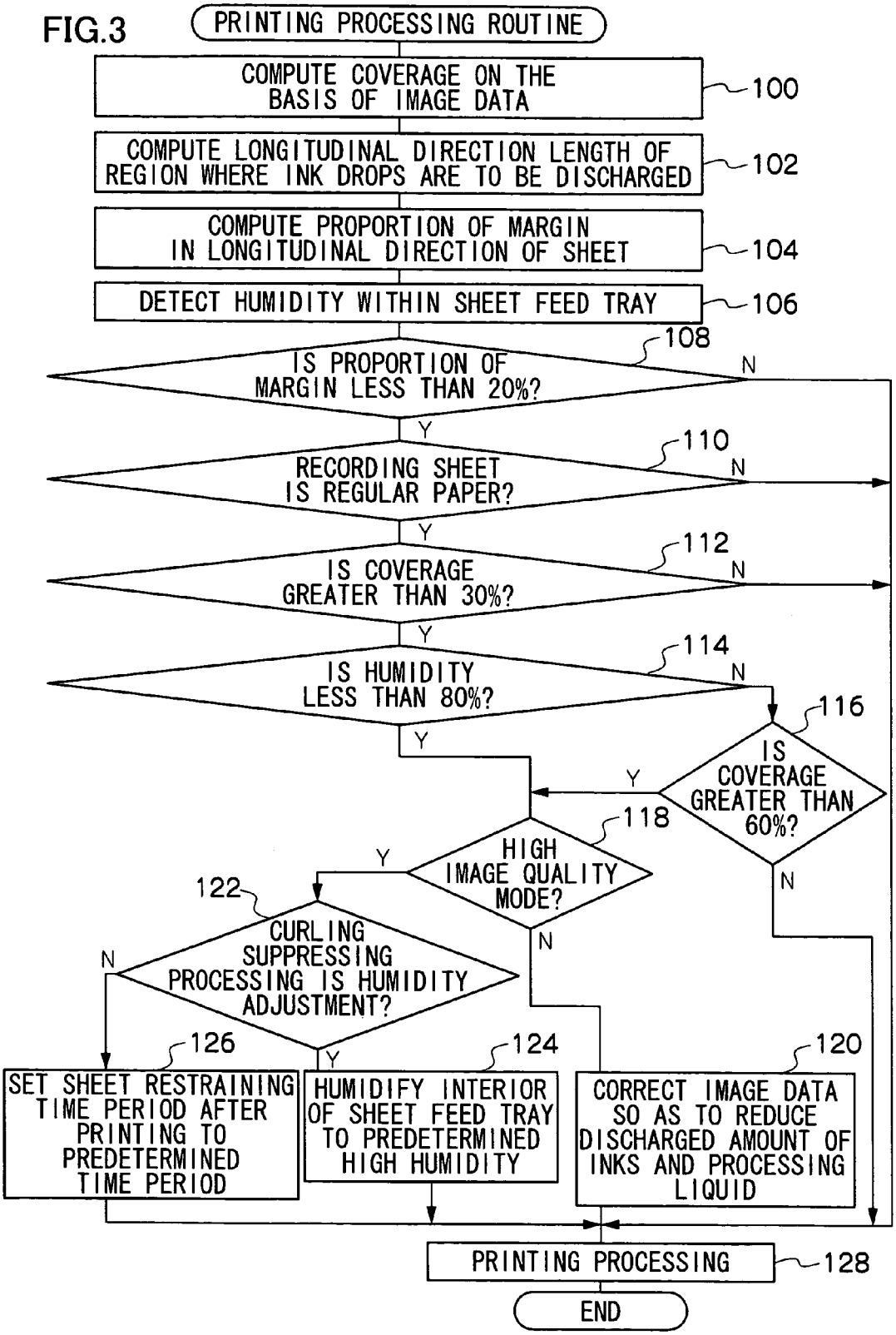
FIG. 3 is a flowchart showing the contents of a printing processing routine of the inkjet recording device relating to the first exemplary embodiment.

First, when image data is prepared and edited by a user at a client PC (not shown), and the image data is inputted to the inkjet recording device 10 together with a print instruction, the printing processing routine shown in FIG. 3 is executed at the controller 62.

In step 100, the coverage is computed on the basis of the inputted image data. Here, the coverage refers to the proportion of the surface area where the recording sheet P is covered by ink, with respect to the surface area of the recording sheet P. Then, in step 102, on the basis of the inputted image data, the length in the longitudinal direction (leading-trailing direction), which is the direction orthogonal to the direction in which the sheet curling will arises, is computed for the discharged region at which the ink drops are to be discharged. In step 104, on the basis of the longitudinal direction length of the discharged region computed in step 102 and the longitudinal direction length of the recording sheet, the proportion of the margin is computed. The proportion of the margin is the proportion of the longitudinal direction lengths of the margins at the leading and trailing ends which are not the discharged region, with respect to the longitudinal direction length of the recording sheet.

In next step 106, the humidity within the sheet feed tray 16 is detected by the humidity sensor 50. In step 108, it is determined whether or not the proportion of the margin computed in step 104 is less than 20%. If the proportion of the margin is greater than or equal to 20% such that there is a sufficient margin on the printed recording sheet, it is determined that curling will not arise, and the routine moves on to step 128. However, if the proportion of the margin is small and is less than 20%, in step 110, it is determined whether or not the recording sheet P is regular paper.

Here, as types of the recording sheet, there can be plural types such as, for example, regular paper (thin paper), coated paper, glossy paper (thick paper), and the like. The user may set the type of the recording sheet at the printer driver of the client PC, and place the recording sheet P of the set type in the sheet feed tray 16, in advance.

If the recording sheet P is other than regular paper such as coated paper or glossy paper or the like, it is determined that curling will not arise at the printed recording sheet P, and the routine moves on to step 128. However, if the recording sheet P is regular paper, the routine moves on to step 112 where it is determined whether or not the coverage computed in step 100 is greater than 30%. If the coverage is 30% or less and therefore low, it is determined that the occurrence of curling of the printed recording sheet P will be suppressed, and the routine moves on to step 128. If the coverage is greater than 30%, the routine proceeds to step 114.

In step 114, it is determined whether or not the humidity detected in step 106 is less than 80%. If the humidity within the sheet feed tray 16 is greater than or equal to 80%, it is determined that it is difficult for curling of the recording sheet P to arise, and in step 116, it is determined whether or not the coverage computed in step 100 is greater than 60%. If the coverage is less than or equal to 60%, it is determined that the occurrence of curling of the recording sheet P will be suppressed in a state of high humidity, and the routine moves on to step 128. However, if the coverage is greater than 60% such that the coverage is very high, curling of the recording sheet P will occur even in a state of high humidity. Therefore, it is determined that curling will arise at the printed recording sheet P, and the routine moves on to step 118.

In above step 114, if the humidity is less than 80%, it is determined that curling will arise at the printed recording sheet P, and the routine moves on to step 118 where it is determined whether or not the printing mode is a high image quality mode. Here, the printing modes can be plural modes such as regular printing mode (a draft printing mode or a high-speed printing mode), high image quality mode, and the like, and the user may set the printing mode in advance by the printer driver at the client PC. In step 118, if the regular printing mode is set as the printing mode, in step 120, the inputted image data is corrected so as to reduce the amount of the inks and processing liquid to be discharged by the inkjet heads. For example, correction is carried out by thinning the image data such that the number of dots which the ink drops and the processing liquid drops are need to be discharged is reduced, and the routine moves on to step 128. In the correcting of the image data, for example, the number of dots that discharge the ink drops and the processing liquid drops are need to be discharged may be reduced uniformly from the entire image and thinned such that the coverage becomes less than or equal to 30%.

On the other hand, if it is determined in above step 118 that the high image quality mode is set, in step 122, it is determined whether or not humidity adjusting processing is set as a curling suppressing processing in the high image quality mode. Here, the curling suppressing processing in the high image quality mode may be provided in order to avoid a deterioration in the image quality due to correction of the image data in the high image quality mode. At the printer driver of the client PC, the user may set either of adjusting of the humidity within the sheet feed tray 16 and restraining of the recording sheet P after printing as the curling suppressing processing in the high image quality mode. If it is determined in above step 122 that humidity adjustment has been set, in step 124, humidifying is carried out by the humidifier 52 such that the humidity within the sheet feed tray 16 becomes a predetermined high humidity (e.g., 70% to 90%), and the routine moves onto step 128.

Further, if it is determined in above step 122 that restraining of the recording sheet P after printing has been set as the curling suppressing processing in the high image quality mode, the time period over which the recording sheet P is restrained by electrostatic attraction at the conveying belt 24 after printing such that curling is corrected, is set to a predetermined time period (e.g., 10 seconds), and the routine moves on to step 128.

Then, in step 128, printing processing is carried out on the basis of the inputted image data or the image data obtained as a result of the correction in step 120, an image is printed on the recording sheet P, and the printing processing routine ends.

Here, in a case in which the sheet restraining time period of the recording sheet P is set in above step 126, after the recording sheet P is printed by the inkjet heads of the inkjet head unit 12, the conveying belt 24 is stopped. The state in which the recording sheet P is restrained and the curling is corrected by electrostatic attraction on the conveying belt 24 at the downstream side of the inkjet heads is maintained for the set predetermined time period. When the predetermined time period elapses, the conveying belt 24 is rotated, and the recording sheet P is discharged-out to the catch tray 42 by the discharging roller pairs 40.

As described above, in accordance with the inkjet recording device relating to the first exemplary embodiment, the proportion of the margin of the printed recording sheet is computed. By determining that sheet curling will arise in a case in which the proportion of the margin is small, the occurrence of curling of the recording sheet can be predicted by taking the margins of the recording sheet into consideration. Further, when it is predicted that curling of the recording sheet will arise, processing for suppressing the occurrence of curling can be carried out.

Further, the proportion of the margin is computed in the direction orthogonal to the direction in which the curling of the recording sheet arises, and the occurrence of curling of the recording sheet can be predicted.

Because the occurrence of curling of the recording sheet is determined on the basis of the humidity within the sheet feed tray and the proportion of the margin, the occurrence of curling of the recording sheet can be further predicted. Moreover, because the occurrence of curling of the recording sheet is determined on the basis of the type of the recording sheet and the proportion of the margin, the occurrence of curling of the recording sheet can be further predicted.

In addition, when the occurrence of curling of the recording sheet is predicted, by carrying out processing for suppressing the occurrence of curling, the occurrence of curling can be suppressed. Further, the occurrence of curling can be suppressed by correcting the image data and reducing the discharged amount of the inks and processing liquid.

By carrying out curling suppressing processing in accordance with the set printing mode, appropriate curling suppressing processing can be carried out. In particular, in the case of the high image quality mode, curling suppressing processing which does not correct the image data is carried out. Therefore, printing can be carried out without deteriorating the image quality.

Note that the above exemplary embodiment describes, as an example, a case in which the printing processing routine is executed at the controller of the inkjet recording device. However, the processings for computing the coverage and the proportion of the margin (above-described step 100 through step 104), the processings for determining whether or not curling will arise (above-described step 108 through step 116), and the processing of correcting the image data (above-described step 120) may be executed at the printer driver of the client PC.

Further, as an example, a case has been described in which the number of dots which is formed by discharge of the ink drops and the drops of the processing liquid is decreased in the image data correcting processing, but the present invention is not limited to the same. The discharged amount of the inks and the processing liquid may be reduced by making the dot diameters of I the ink drops and the drops of the processing liquid uniformly small.

Moreover, a case of computing the proportion of the margin in the longitudinal direction (the proportion of the margins of the leading and trailing ends) has been described as an example. However, in a case in which the recording sheet curls in the longitudinal direction, the proportion of the margin in the transverse direction (the proportion of the margins of the left and right ends) may be computed, and whether or not curling will arise at the printed recording sheet may be determined on the basis of the proportion of the margin in the transverse direction.

A case in which the interior of the sheet feed tray is humidified before printing has been described as an example of the humidity adjustment which is a curling suppressing processing, but the present invention is not limited to the same. The printed recording sheet may be humidified by the humidifier after being printed and before being discharged-out onto the catch tray.

Still further, as an example, there has been described a case in which either one of sheet restraining or humidifying is carried out as the curling suppressing processing when the high image quality mode is set as the printing mode. However, the present invention is not limited to the same, and both of these processings may be combined.

In addition, although a case of detecting the humidity within the sheet feed tray by the humidity sensor has been described as an example, the humidity at another position within the inkjet recording device may be detected.

A second exemplary embodiment will be described next. Note that portions which are similar to those of the first exemplary embodiment are denoted by the same reference numerals, and description thereof is omitted. The second exemplary embodiment differs from the first exemplary embodiment with regard to the point that double-sided printing is carried out in the second exemplary embodiment.

Figure 4:
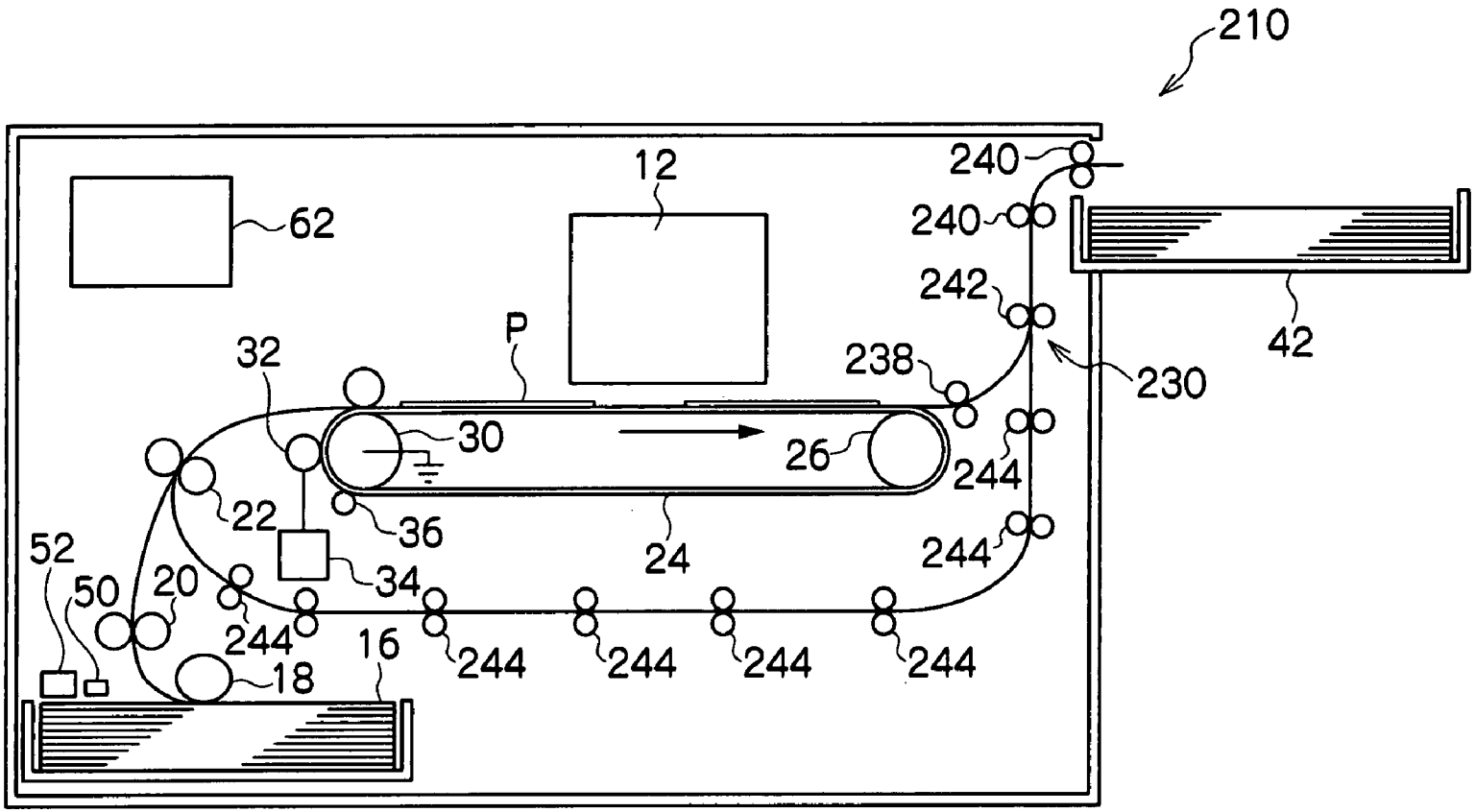
FIG. 4 is a schematic drawing showing the structure of an inkjet recording device relating to a second exemplary embodiment.

As shown in FIG. 4, an inkjet recording device 210 relating to a second exemplary embodiment has an inverting mechanism 230. The inverting mechanism 230 has a conveying roller pair 242, which is provided along a discharge path which is structured by discharging roller pairs 238, 240, and conveying roller pairs 244 which structure an inverting path.

In a case of carrying out double-sided printing, the recording sheet P, at which only one side thereof has been printed, is, after being conveyed to midway along the discharge path, conveyed to the inverting path by the conveying roller pair 242 being rotated reversely. Then, the recording sheet P, which is conveyed along the inverting path by the conveying rollers 244, is again fed by the conveying rollers 22 to the region beneath the inkjet head unit 12.

Figure 5:
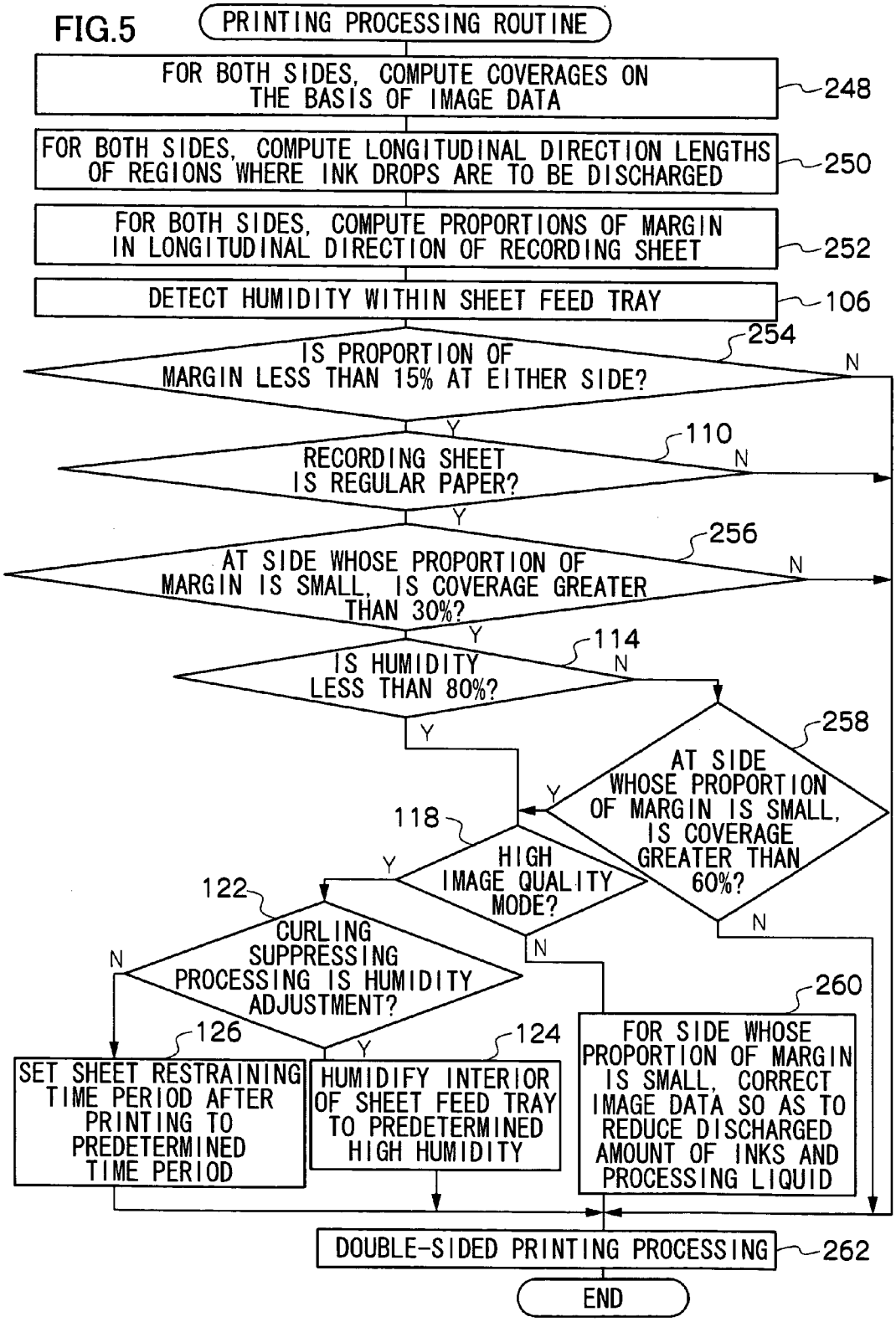
FIG. 5 is a flowchart showing the contents of a printing processing routine of the inkjet recording device relating to the second exemplary embodiment.

Next, a printing processing routine relating to the second exemplary embodiment will be described by using FIG. 5. Note that processings which are similar to those of the first exemplary embodiment are denoted by the same reference numerals, and detailed description thereof is omitted.

First, in step 248, the coverages are computed for the both sides on the basis of the inputted image data. In step 250, the longitudinal direction lengths of the discharged regions at which the ink drops are to be discharged are computed for the both sides on the basis of the inputted image data. Then, in step 252, the proportions of the margins of the recording sheet are computed for the both sides on the basis of the longitudinal direction lengths of the discharged regions computed in step 250 and the longitudinal direction length of the recording sheet.

In next step 106, the humidity within the sheet feed tray 16 is detected by the humidity sensor 50. In step 254, it is determined whether or not the proportion of the margin computed in step 252 is less than 15% at either of the front side or the back side. If the proportions of the margins are greater than or equal to 15% at both of the sides such that there are sufficient margins at both sides of the printed recording sheet, it is determined that sheet curling will not occur, and the routine moves on to step 262. On the other hand, if the proportion of the margin is small and is less than 15% at either of the front side and the back side, in step 110, it is determined whether or not the recording sheet P is regular paper. If the recording sheet P is other than regular paper, such as is coated paper or glossy paper or the like, it is determined that curling will not arise at the printed recording sheet P, and the routine moves on to step 262. However, if the recording sheet P is regular paper, the routine proceeds to step 256, and, for the side whose proportion of the margin was determined to be less than 15% in step 254, it is determined whether or not the coverage computed in step 248 is greater than 30%. If the coverage at the side whose proportion of the margin is small is less than or equal to 30% such that it is small, it is determined that the occurrence of curling of the printed recording sheet P will be suppressed, and the routine moves on to step 262. However, if the coverage at the side whose proportion of the margin is small is greater than 30%, the routine proceeds to step 114.

In step 114, it is determined whether or not the humidity detected in step 106 is less than 80%. If the humidity is greater than or equal to 80%, in step 258, it is determined, for the side whose proportion of the margin was determined to be less than 15% in step 254, whether or not the coverage computed in step 248 is greater than 60%. If the coverage is less than or equal to 60%, it is determined that sheet curling will be suppressed, and the routine moves on to step 262. If the coverage is greater than 60%, curling of the recording sheet P will arise even in a state of high humidity. Therefore, it is determined that sheet curling will arise, and the routine moves on to step 118.

If the humidity is less than 80% in step 114, it is determined that sheet curling will arise, and the routine moves on to step 118 where it is determined whether or not the printing mode is the high image quality mode. If it is determined in step 118 that a printing mode other than the high image quality mode such as regular printing mode has been set, in step 260, for the side whose proportion of the margin was determined to be less than 15% in step 254, the inputted image data is thinned and corrected such that the amount of the inks and the processing liquid to be discharged by the inkjet heads is reduced. The routine then moves on to step 262.

On the other hand, if it is determined in above step 118 that the high image quality mode is set, in step 122 it is determined whether or not humidity adjusting processing is set as the curling suppressing processing in the high image quality mode. If it is determined that humidity adjustment is set, in step 124, humidifying is carried out by the humidifier 52 such that the humidity within the sheet feed tray 16 becomes a predetermined high humidity, and the routine moves on to step 262.

Further, in above step 122, if restraining of the recording sheet P after printing is set as the curling suppressing processing of the high image quality mode, the time period for restraining the recording sheet P by electrostatic attraction at the conveying belt 24 after printing is set to a predetermined time period, and the routine moves on to step 262.

Then, in step 262, on the basis of the inputted image data or the image data obtained as a result of correction in step 260, double-sided printing processing is carried out, images are printed onto the front side and the back side of the recording sheet P, and the printing processing routine ends.

As described above, in accordance with the inkjet recording device relating to the second exemplary embodiment, in double-sided printing, the proportions of the margin of the printed recording sheet are computed for the both sides. By determining that sheet curling will arise in a case in which the proportion of the margin of either side is small, the occurrence of curling of the recording sheet can be predicted while taking the margins of the recording sheet into consideration. Further, when it is predicted that curling of the recording sheet will occur, processing for suppressing the occurrence of curling can be carried out.

Moreover, when the occurrence of curling of the recording sheet is predicted, image data correction processing for suppressing the occurrence of sheet curling is carried out with respect to the surface whose proportion of the margin is small. The occurrence of sheet curling can thereby be suppressed.

A third exemplary embodiment will be described next. Note that portions which are similar to those of the first exemplary embodiment are denoted by the same reference numerals, and description thereof is omitted.

The third exemplary embodiment differs from the first exemplary embodiment with respect to the point that, in the third exemplary embodiment, as the curling suppressing processing, the proportion of the margin is set and the image data is compressed such that the image is kept within that range.

Because the structure of the inkjet recording device is similar to that in the first exemplary embodiment, description relating to the structure is omitted.

Figure 6:
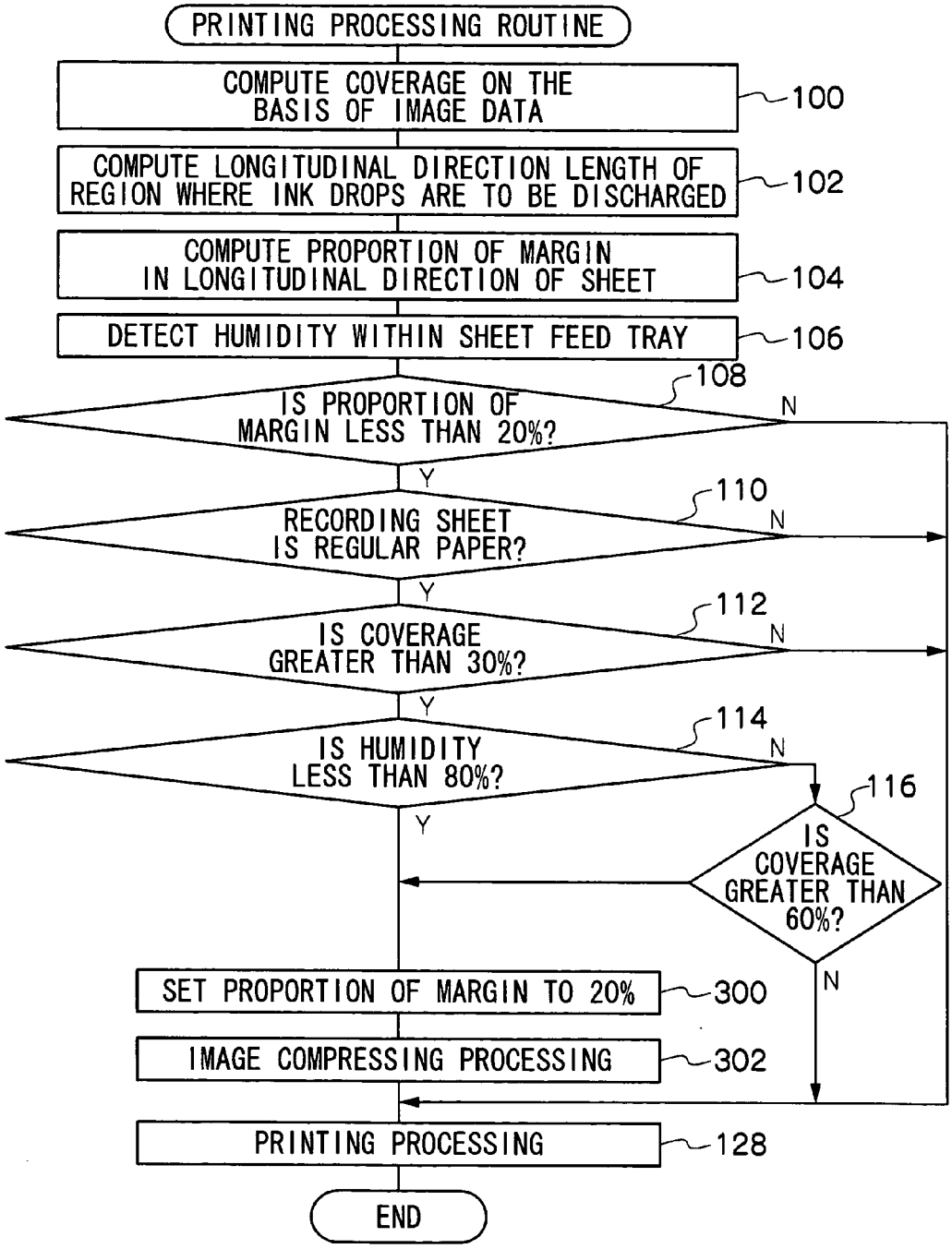
FIG. 6 is a flowchart showing the contents of a printing processing routine of an inkjet recording device relating to a third exemplary embodiment.

A printing processing routine relating to the third exemplary embodiment will be described with reference to FIG. 6. Note that processings which are similar to those of the first exemplary embodiment are denoted by the same reference numerals, and detailed description thereof is omitted.

In step 100, the coverage is computed on the basis of the inputted image data. In step 102, the longitudinal direction length of the discharged region where the ink drops are to be discharged is computed, and in step 104, the proportion of the margin of the recording sheet is computed.

In next step 106, the humidity within the sheet feed tray 16 is detected, and in step 108, it is determined whether or not the proportion of the margin is less than 20%. If the proportion of the margin is greater than or equal to 20%, the routine moves on to step 128. On the other hand, if the proportion of the margin is less than 20%, in step 110, it is determined whether or not the recording sheet P is regular paper. If the recording sheet P is not regular paper such as coated paper or glossy paper, the routine moves on to step 128. On the other hand, if the recording sheet P is regular paper, the routine proceeds to step 112.

Then, in step 112, it is determined whether or not the coverage is greater than 30%. If the coverage is less than or equal to 30%, the routine moves on to step 128. However, if the coverage is greater than 30%, the routine proceeds to step 114. In step 114, it is determined whether or not the detected humidity is less than 80%. If the humidity within the sheet feed tray 16 is greater than or equal to 80%, in step 116, it is determined whether or not the computed coverage is greater than 60%. If the coverage is less than or equal to 60%, the routine moves on to step 128. If the coverage is greater than 60% such that the coverage is very high, the routine moves on to step 300.

Further, if it is determined that the humidity is less than 80% in above step 114, the routine moves on to step 300 where the proportion of the margin of the recording sheet P is set to 20%. In step 302, image compressing processing is carried out which compresses the image data such that the ink drop discharged region of the inputted image data is reduced and kept inside of the margins which are based on the set proportion of the margin.

Then, in step 128, printing processing is carried out on the basis of the inputted image data or the image data obtained as a result of the image compressing processing in step 302, an image is printed on the recording sheet P, and the printing processing routine ends.

As described above, in accordance with the inkjet recording device relating to the third exemplary embodiment, if the occurrence of sheet curling is predicted, the proportion of the margin is set to be large, and the image data is compressed such that the ink drop discharged region of the image data is reduced and kept inside of the margins which are based on the set proportion of the margin. In this way, the discharged amount of the inks and the processing liquid is reduced, the proportion of the margin is increased, and the occurrence of curling can be suppressed.

A fourth exemplary embodiment will be described next. Portions which are similar to those of the first through third exemplary embodiments are denoted by the same reference numerals, and description thereof is omitted. The fourth exemplary embodiment differs from the third exemplary embodiment with respect to the point that double-sided printing is carried out in the fourth exemplary embodiment.

Because the structure of the inkjet recording device is similar to that in the second exemplary embodiment, description relating to the structure is omitted.

Figure 7:
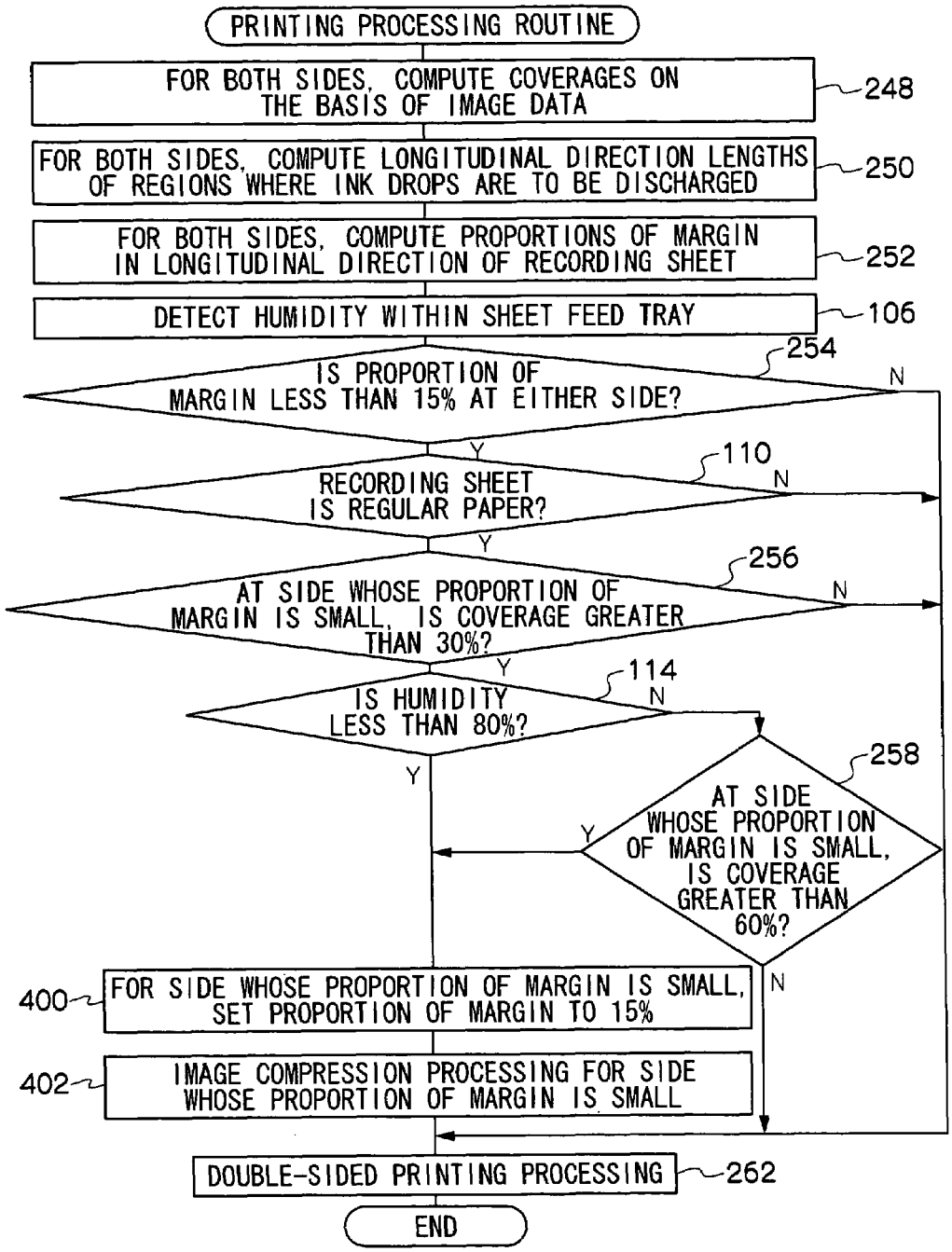
FIG. 7 is a flowchart showing the contents of a printing processing routine of an inkjet recording device relating to a fourth exemplary embodiment.

A printing processing routine relating to the fourth exemplary embodiment will be described in accordance with FIG. 7. Note that processings which are similar to those of the first through third exemplary embodiments are denoted by the same reference numerals, and detailed description thereof is omitted.

First, in step 248, the coverages are computed for the both sides on the basis of the inputted image data. In step 250, the longitudinal direction lengths of the discharged regions at which the ink drops are to be discharged are computed for the both sides. In step 252, the proportions of the margins of the recording sheet are computed for the both sides.

In next step 106, the humidity within the sheet feed tray 16 is detected by the humidity sensor 50. In step 254, it is determined whether or not the proportion of the margin computed in step 252 is less than 15% at either of the front side or the back side. If the proportions of the margins are greater than or equal to 15% at both of the sides, the routine moves on to step 262. On the other hand, if the proportion of the margin is less than 15% at either of the front side and the back side, in step 110, it is determined whether or not the recording sheet P is regular paper. If the recording sheet P is other than regular paper, such as is coated paper or glossy paper or the like, the routine moves on to step 262. If the recording sheet P is regular paper, the routine proceeds to step 256.

For the side whose proportion of the margin was determined to be less than 15%, it is determined in step 256 whether or not the computed coverage is greater than 30%. If the coverage, at the side whose proportion of the margin is small, is less than or equal to 30% such that it is small, the routine moves on to step 262. If the coverage at the side whose proportion of the margin is small is greater than 30%, the routine proceeds to step 114.

In step 114, it is determined whether or not the detected humidity is less than 80%. If the humidity is greater than or equal to 80%, in step 258, it is determined, for the side whose proportion of the margin was determined to be less than 15%, whether or not the computed coverage is greater than 60%. If the coverage is less than or equal to 60%, the routine moves on to step 262. However, if the coverage is greater than 60%, the routine moves on to step 400.

If the humidity is less than 80% in step 114, the routine moves on to step 400 where, for the side whose proportion of the margin was determined to be less than 15%, the proportion of the margin of the recording sheet P is set to 15%. In step 402, for the side whose proportion of the margin was determined to be less than 15%, image compressing processing is carried out which compresses the image data such that the ink drop discharged region of the inputted image data is reduced and kept inside of the margins which are based on the set proportion of the margin.

Then, in step 262, on the basis of the inputted image data or the image data obtained as a result of the image compressing processing in step 402, double-sided printing processing is carried out, images are printed onto the front side and the back side of the recording sheet P, and the printing processing routine ends.

As described above, in accordance with the inkjet recording device relating to the fourth exemplary embodiment, if the occurrence of curling is predicted, for the side whose proportion of the margin is small, the proportion of the margin is set to be large, and the image data is compressed such that the ink drop discharged region of the image data is reduced and kept inside of the margins which are based on the set proportion of the margin. In this way, the discharged amount of the inks and the processing liquid is reduced, the proportion of the margin is increased, and the occurrence of curling can be suppressed.

A fifth exemplary embodiment will be described next. Portions which are similar to those of the first and third exemplary embodiments are denoted by the same reference numerals, and description thereof is omitted.

The fifth exemplary embodiment differs from the first and the third exemplary embodiments with respect to the point that, in the fifth exemplary embodiment, it is determined whether or not curling will arise at the printed recording sheet on the basis of the proportion of the region where the ink drops and the drops of the processing liquid are to be discharged.

Here, if the proportion of the discharged region, which is the proportion of the region where the ink drops and the drops of the processing liquid are to be discharged, is large, the proportion of the margin will be small, and therefore, it is considered that sheet curling will occur. On the other hand, if the proportion of the discharged region is small, the proportion of the margin will be large, and therefore, it is considered that sheet curling will not occur.

Because the structure of the inkjet recording device is similar to that in the first exemplary embodiment, description relating to the structure is omitted.

Figure 8:
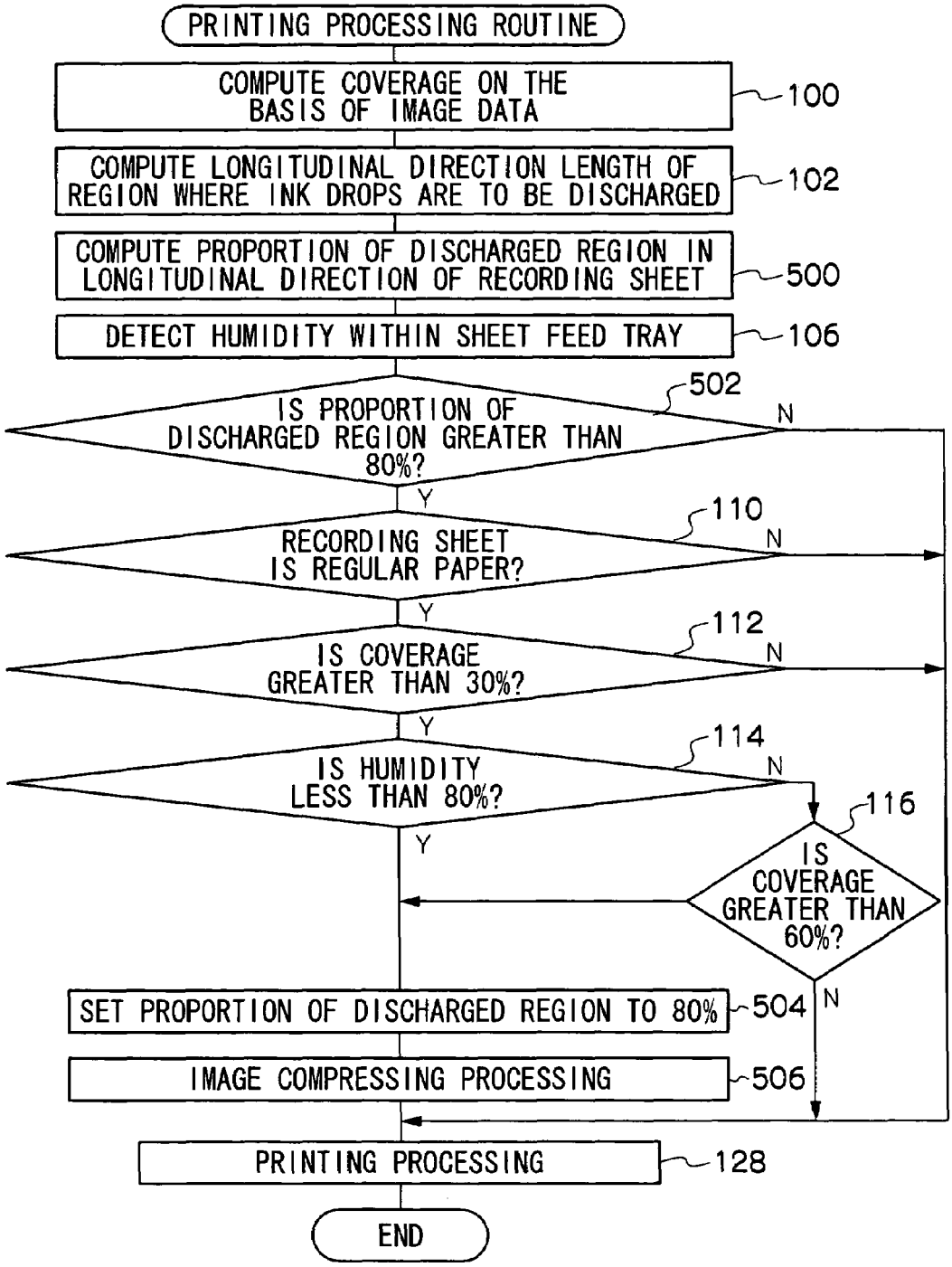
FIG. 8 is a flowchart showing the contents of a printing processing routine of an inkjet recording device relating to a fifth exemplary embodiment.

A printing processing routine relating to the fifth exemplary embodiment will be described by using FIG. 8. Note that processings which are similar to those of the first and third exemplary embodiments are denoted by the same reference numerals, and detailed description thereof is omitted.

In step 100, the coverage is computed on the basis of the inputted image data. In step 102, the longitudinal direction length of the discharged region where the ink drops are to be discharged is computed. In step 500, the proportion of the discharged region is computed on the basis of the longitudinal direction length of the discharged region computed in step 102 and the longitudinal direction length of the recording sheet. The proportion of the discharged region is the proportion of the longitudinal direction length of the discharged region to the longitudinal direction length of the recording sheet.

In next step 106, the humidity within the sheet feed tray 16 is detected. In step 502, it is determined whether or not the proportion of the discharged region is greater than 80%. If the proportion of the discharged region is less than or equal to 80%, it is determined that sheet curling will not arise, and the routine moves on to step 128. On the other hand, if the proportion of the discharged region is greater than 80%, in step 110, it is determined whether or not the recording sheet P is regular paper. If the recording sheet P is other than regular paper, such as is coated paper or glossy paper or the like, the routine moves on to step 128. On the other hand, if the recording sheet P is regular paper, the routine proceeds to step 112.

Then, in step 112, it is determined whether or not the coverage is greater than 30%. If the coverage is less than or equal to 30% such that the coverage is small, the routine moves on to step 128. If the coverage is greater than 30%, the routine proceeds to step 114. In step 114, it is determined whether or not the detected humidity is less than 80%. If the humidity within the sheet feed tray 16 is greater than or equal to 80%, in step 116, it is determined whether or not the computed coverage is greater than 60%. If the coverage is less than or equal to 60%, the routine moves on to step 128. If the coverage is greater than 60% such that the coverage is very high, it is determined that sheet curling will occur, and the routine moves on to step 504.

Further, if it is determined that the humidity is less than 80% in above step 114, it is determined that sheet curling will occur. The routine moves on to step 504 where the proportion of the discharged region of the recording sheet P is set to 80%. In step 506, image compressing processing is carried out which compresses the image data such that the ink drop discharged region of the inputted image data is reduced and kept within the discharged region which is based on the set proportion of the discharged region.

Then, in step 128, printing processing is carried out on the basis of the inputted image data or the image data obtained as a result of the image compressing processing in step 506, an image is printed on the recording sheet P, and the printing processing routine ends.

As described above, in accordance with the inkjet recording device relating to the fifth exemplary embodiment, the proportion of the discharged region of the recording sheet is computed, and if the proportion of the discharged region is large, it is determined that sheet curling will arise. In this way, the occurrence of curling of the recording sheet can be predicted by taking the margins of the recording sheet into consideration. Further, when it is predicted that curling of the recording sheet will arise, processing for suppressing the occurrence of curling can be carried out.

Further, the proportion of the discharged region is computed in the direction orthogonal to the direction in which the curling of the recording sheet arises, and the occurrence of curling of the recording sheet can be predicted.

The occurrence of curling of the recording sheet is determined on the basis of the humidity within the sheet feed tray and the proportion of the discharged region. Therefore, the occurrence of curling of the recording sheet can be further predicted. Moreover, the occurrence of curling of the recording sheet is determined on the basis of the type of the recording sheet and the proportion of the discharged region. Therefore, the occurrence of curling of the recording sheet can be further predicted.

If the occurrence of sheet curling is predicted, the proportion of the discharged region is set to be small, and the image data is compressed such that the ink drop discharged region of the image data is reduced and kept within the discharged region which is based on the set proportion of the discharged region. In this way, the discharged amount of the inks and the processing liquid is reduced, the proportion of the margin is increased, and the occurrence of curling can be suppressed.

The foregoing description of the exemplary embodiments of the present invention has been provided for the purpose of illustration and description. It is not intended to be exhaustive or to limit the invention to the precise form disclosed herein. Obviously, many modifications and variations will be apparent to a practitioner skilled in the art. The exemplary embodiments were chosen and described in order to best explain the principles of the invention and its practical applications, thereby enabling others skilled in the art to understand the invention according to various embodiments and with various modifications as are suited to the particular use contemplated. It is intended that the scope of the invention be defined by the following claims and their equivalents.

What is claimed is:

1. A liquid drop discharging device comprising:

a liquid drop discharging head that discharges liquid drops onto a recording sheet;

a discharged region computing section that, on the basis of inputted image data, computes a size of a region where liquid drops are to be discharged on the recording sheet by the liquid drop discharging head;

a margin proportion computing section that, on the basis of the computed size of the discharged region and a size of the recording sheet, computes a proportion of a margin of the recording sheet; and a determination section that, when the computed proportion of the margin is less than a predetermined margin proportion, determines that sheet curling will occur at the recording sheet on which an image is recorded by liquid drop discharging of the liquid drop discharging head.

2. The liquid drop discharging device of claim 1, wherein the discharged region computing section computes a length of the discharged region in either one direction of a longitudinal direction or a transverse direction of the recording sheet, and the margin proportion computing section computes the proportion of the margin of the recording sheet on the basis of the computed length of the discharged region and a length of the recording sheet in the one direction.

3. The liquid drop discharging device of claim 1, further comprising a humidity detecting section that detects humidity within a sheet feed tray that accommodates the recording sheet, wherein, when the computed proportion of the margin is less than the predetermined margin proportion and the detected humidity is less than a predetermined humidity, the determination section determines that sheet curling will occur at the recording sheet on which an image is recorded by liquid drop discharging of the liquid drop discharging head.

4. The liquid drop discharging device of claim 1, wherein the recording sheet is selected from a plurality of types of the recording sheet, and when the computed proportion of the margin is less than the predetermined margin proportion and the recording sheet is a predetermined type, the determination section determines that sheet curling will occur at the recording sheet on which an image is recorded by liquid drop discharging of the liquid drop discharging head.

5. The liquid drop discharging device of claim 1, wherein an discharging region of the liquid drop discharging head is a width of the recording sheet.

6. The liquid drop discharging device of claim 1, further comprising a curling suppressing section that, when the determination section determines that sheet curling will occur at the recording sheet, carries out processing which suppresses occurrence of the sheet curling.

7. The liquid drop discharging device of claim 6, further comprising an image recording mode setting section which sets an image recording mode from among a plurality of predetermined image recording modes, wherein the curling suppressing processing is selected from a plurality of the curling suppressing processing, and when it is determined that sheet curling will occur at the recording sheet, the curling suppressing section carries out one of the plurality of curling suppressing processings in accordance with the image recording mode set by the image recording mode setting section.

8. The liquid drop discharging device of claim 6, wherein the liquid drops are formed of at least one of ink and a processing liquid, and the curling suppressing section reduces an amount of at least one of the ink and the processing liquid discharged by the liquid drop discharging head.

9. The liquid drop discharging device of claim 8, wherein the curling suppressing section corrects the image data so as to decrease a number of dots formed by the liquid drops discharged onto the recording sheet by the liquid drop discharging head.

10. The liquid drop discharging device of claim 8, wherein the processing liquid comprises an aqueous solution having at least one of an effect of cohering a component of the liquid drops and an effect of making a component of the liquid drops insoluble.

11. The liquid drop discharging device of claim 8, wherein the curling suppressing section corrects the image data so as to reduce a region where the liquid drops are discharged onto the recording sheet by the liquid drop discharging head.

12. A liquid drop discharging device comprising:

a liquid drop discharging head that discharges liquid drops onto a recording sheet;

an discharged region computing section which, on the basis of inputted image data, computes a size of a region where liquid drops are to be discharged on the recording sheet by the liquid drop discharging head;

a discharged region proportion computing section which, on the basis of the computed size of the discharged region and a size of the recording sheet, computes a proportion of the discharged region of the recording sheet; and a determination section which, when the computed proportion of the discharged region is greater than a predetermined discharged region proportion, determines that sheet curling will occur at the recording sheet on which an image is recorded by liquid drop discharging of the liquid drop discharging head.

13. The liquid drop discharging device of claim 12, wherein the discharged region computing section computes a length of the discharged region in either one direction of a longitudinal direction or a transverse direction of the recording sheet, and the discharged region proportion computing section computes the proportion of the discharged region of the recording sheet on the basis of the computed length of the discharged region and a length of the recording sheet in the one direction.

14. The liquid drop discharging device of claim 12, further comprising a humidity detecting section that detects humidity within a sheet feed tray that accommodates the recording sheet, wherein, when the computed proportion of the discharged region is greater than the predetermined discharged region proportion and the detected humidity is less than a predetermined humidity, the determination section determines that sheet curling will occur at the recording sheet on which an image is recorded by liquid drop discharging of the liquid drop discharging head.

15. The liquid drop discharging device of claim 12, wherein the recording sheet is selected from a plurality of types of the recording sheet, and when the computed proportion of the discharged region is greater than the predetermined discharged region proportion and the recording sheet is a predetermined type, the determination section determines that sheet curling will occur at the recording sheet on which an image is recorded by liquid drop discharging of the liquid drop discharging head.

16. A liquid drop discharging method in a liquid drop discharging device that includes a liquid drop discharging head discharging liquid drops onto a recording sheet, the method comprising:

on the basis of inputted image data, computing a size of a region where liquid drops are to be discharged on the recording sheet by the liquid drop discharging head;

on the basis of the computed size of the discharged region and a size of the recording sheet, computing a proportion of a margin of the recording sheet; and when the computed proportion of the margin is less than a predetermined margin proportion, determining that sheet curling will occur at the recording sheet on which an image is recorded by liquid drop discharging of the liquid drop discharging head.

17. The liquid drop discharging method of claim 16, wherein the computing of the discharged region comprises computing a length of the region in either one direction of a longitudinal direction or a transverse direction of the recording sheet, and the computing of the proportion of the margin comprises computing the proportion of the margin of the recording sheet on the basis of the computed length of the discharged region and a length of the recording sheet in the one direction.

18. The liquid drop discharging method of claim 16, further comprising detecting humidity within a sheet feed tray that accommodates the recording sheet, wherein, when the computed proportion of the margin is less than the predetermined margin proportion and the detected humidity is less than a predetermined humidity, it is determined that sheet curling will occur at the recording sheet.

19. The liquid drop discharging method of claim 16, wherein the recording sheet is selected from a plurality of types of the recording sheet, and when the computed proportion of the margin is less than the predetermined margin proportion and the recording sheet is a predetermined type, it is determined that sheet curling will occur at the recording sheet.

20. The liquid drop discharging method of claim 16, further comprising, when it is determined that sheet curling will occur at the recording sheet, carrying out processing which suppresses occurrence of the sheet curling.

21. A liquid drop discharging method in a liquid drop discharging device that includes a liquid drop discharging head discharging liquid drops onto a recording sheet, the method comprising:

on the basis of inputted image data, computing a size of a region where liquid drops are to be discharged on the recording sheet by the liquid drop discharging head;

on the basis of the computed size of the discharged region and a size of the recording sheet, computing a proportion of the discharged region of the recording sheet; and when the computed proportion of the discharged region is greater than a predetermined discharged region proportion, determining that sheet curling will occur at the recording sheet on which an image is recorded by liquid drop discharging of the liquid drop discharging head.

* * * * *